US006163935A

United States Patent [19]

Hinkey

[11] Patent Number: 6,163,935

[45] Date of Patent: Dec. 26, 2000

[54] METHOD AND APPARATUS FOR SECURING PLEASURE CRAFTS

[76] Inventor: Lawrence A. Hinkey, 22 Grove Ave., Glen Falls, N.Y. 12801

[21] Appl. No.: 09/028,138

[22] Filed: Feb. 23, 1998

Related U.S. Application Data

[60] Provisional application No. 60/041,663, Mar. 25, 1997.

[51] Int. Cl.[7] ..... E05B 73/00

[52] U.S. Cl. ..... 24/71 TD; 24/71 CT

[58] Field of Search ..... 70/18, 58; 24/68 R, 24/70 CT, 70 ST, 69 ST, 69 CT, 69 CF, 69 WT, 69 R, 71 R, 71 ST, 71 TD, 71 CT, 68 CD, 70 R

[56] References Cited

U.S. PATENT DOCUMENTS

| | | |
|---|---|---|
| 257,263 | 5/1882 | Wood . |
| D. 365,236 | 12/1995 | Stockwell . |
| 1,377,413 | 5/1921 | Dwelle . |
| 1,401,067 | 12/1921 | Garvey . |
| 4,680,949 | 7/1987 | Stewart . |
| 4,873,848 | 10/1989 | Honeymann, III . |
| 5,119,649 | 6/1992 | Spence . |
| 5,159,729 | 11/1992 | Walker . |
| 5,181,402 | 1/1993 | Faessler et al. . |
| 5,187,840 | 2/1993 | Kaczorowski . |
| 5,440,790 | 8/1995 | Chou . |

*Primary Examiner*—James R. Brittain
*Attorney, Agent, or Firm*—John Pietrangelo

[57] ABSTRACT

Various methods and devices for securing pleasure craft, for example, surf boards, snow boards, or canoes, which provide for ease of securing the craft and ease of releasing the craft are disclosed. These methods and devices typically employ some form of cables or other tensile members and cable locking or securing devices. Cable securing and locking devices are also disclosed. In particular, various cable securing devices consisting of a first u-shaped channels and a second u-shaped channel pivotably connected to the first u-shaped channel are disclosed. These u-shaped channels include cable attaching and tensioning devices which facilitate the restraint and removal of the cable. One attaching device includes a threaded nut-type fastener for retaining the cable in the channel and rotating disk element over which the cable passes which facilitates the tensioning of the cable during restraint of a craft or other device.

30 Claims, 9 Drawing Sheets

METHOD AND APPARATUS FOR SECURING PLEASURE CRAFTS

This application claims the benefit of U.S. Provisional Application Ser. No. 60/041,663 filed on Mar. 25, 1997.

SUMMARY OF INVENTION

The present invention provides a method and apparatus for securely storing or transporting pleasure craft that circumvents the disadvantages of the prior art. The present invention provides a means for securing pleasure craft for storage or transport that allows for quick and easy restraining and release of the craft with minimal effort. This securing of the craft typically includes a means for preventing theft or unauthorized use of the craft. That is, the securing means typically includes a means for "locking up" the craft. The present invention also provides a method and apparatus for securing the ends of cables used to retain articles, such as pleasure craft, for storage or transport.

BACKGROUND AND INTRODUCTION

Surfboards, snow boards, and kayaks, for example, are often difficult to store securely due to their long, unwieldy shapes. These pleasure craft, and others like them, often must be securely stored or retained, for example, for transport or simply to prevent theft, while at the same time being easily accessible to the user. The present invention consists of methods and apparatus for retaining one or more pleasure craft, for example, surfboards, wind surfboards, snow and water skis, snow boards, kayaks and canoes, and the like, such that the craft can be quickly and easily securely retained for storage or transport and, when necessary, quickly and easily released from restraint.

Conventional pleasure craft, such as surfboards or wind surfboards, are recognized for their light weight and durability, but due to their inherent size are cumbersome to store and especially cumbersome to transport. Secure storage and transport can be particularly difficult when more than one craft is being transported, for example, on the roof of a car or by means of a trailer towed by a car or other means. Typical conventional methods of transporting such craft include car "roof racks" that often require a rather cumbersome and time-consuming process to attach the craft to the rack and subsequent removal from the rack.

Also, conventional methods of securely storing several such craft to prevent theft are limited to storing such craft behind locked doors or, if stored outside, stored in fenced enclosures. These methods typically inconvenience the user since the craft typically have to be hand-carried from the storage area to the location it will be used, for example, to the beach or ski slope. Though storage devices typically appear in trade journals, these devices typically provide minimal protection from theft. If conventional devices do provide some means of protection from theft, removal of the craft from such devices by the user is typically difficult and time consuming. In addition such devices typically rely on other means for preventing theft, for example, a locked gate or door.

Some prior art means for securing such craft from theft or unauthorized use employ devices that are physically attached to the craft such that the surface of the craft must be modified in some way. For example, some prior art consists of threaded connections or other attachments, such as shown in U.S. Pat. No. 5,119,649, for securing the craft to a cable, for example, by means of a padlock. One of the disadvantages of such a device is that the surface of the craft must be physically altered to accommodate such a locking device. In addition, when a protective cover is placed over the craft—as is typical to prevent physical damage, especially during transport—such prior art locking devices are typically inaccessible without the inconvenience of removing the cover. These and other limitations of the prior art are circumvented by the method and apparatus of the present invention.

One embodiment of the present invention consists of an apparatus for securing at least one pleasure craft, having a first end and a second end, to a rigid support so that the craft is secured against unauthorized removal while providing easy access to the owner or authorized user. The apparatus consists of a first loop of cable that is passed over the first end of the craft; a second loop of cable that is passed over the second end of the craft; and a means for securing the first loop to the second loop while engaging the rigid support such that the craft is secured to the rigid support. It is to be understood that the term "cable" can refer to any form of tensile member, for example, natural fiber or synthetic fiber rope, chord, or strap; or metal chain or metal cable, or the like. The cable is preferably one that provides at least some degree of security from breakage or theft, for example, it is not easily cut by conventional means. For example, one preferred cable is one consisting of braided metal wire, e.g., braided steel wire, enclosed in a wear-resistant plastic cover. This cover, or other means of preventing abrasion of the surface of the craft or support, is particularly preferred in areas where the cable bears against the craft or support.

In a preferred embodiment of the invention, the first cable loop is formed from a continuous length of cable, the first end of which is secured to an intermediate location of the cable itself to form the first loop and the second end of the continuous cable includes a means for securing it to the second loop. The second loop may also consist of a second continuous length of cable forming the second loop at a first end and having a second end with a means for securing the second end of the second length of cable to the second end of the first length of cable. Another embodiment of this invention consists of a single length of cable having a first end and a second end. The first end of the single length of cable includes a means for securing or attaching the first end to an intermediate point on the cable to form a first loop and the second end includes a means for securing the second end to an intermediate point on the cable to form a second loop. The first and second loops are attached to a pleasure craft and engage a rigid support as described in the earlier embodiments.

This invention also includes a method for securing at least one pleasure craft, having a first end and a second end, to a rigid support by means of one or more cables so that the craft is secured against unauthorized removal while providing easy access to the owner or authorized user. This method consists of a) forming a first loop of cable and placing the loop over a first end of the craft; b) forming a second loop of cable and passing the second loop over the second end of the craft; and c) securing the first loop to the second loop, while engaging the rigid support, to secure the craft to the support. Step c) preferably includes removablely securing the first loop to the second loop so that an authorized user can disconnect the first loop from the second loop so that the one or more crafts can be removed.

This invention also includes a method for securing a pleasure craft to a rigid support for transport or storage, the rigid support having two or more elongated members, by means of a first cable having a terminal loop and a locking device and a second cable in the shape of a loop, consisting of: a) placing the craft against the elongated members; b) placing the terminal loop of said first cable over one end of the craft; c) placing the second cable loop over the other end of the craft; and d) securing the locking device of the first cable to the loop of the second cable such that the craft and cable are secured to the rigid support.

Another embodiment of this invention consists of an apparatus for securing a first cable end to a second cable end while providing cable tensioning and release. This apparatus may be used to secure one or more pleasure craft as described above, but it may be used for securing any cable ends, especially any cable ends of a cable requiring tensioning and ease of release. This embodiment of the invention consists of a device for securing a first cable end to a second cable end consisting of: a first u-shaped channel having a first end and a second end, the first channel having a means for securing the first cable end adjacent to the second end of the channel; and a second u-shaped channel having a first end pivotably connected to the first end of the first channel, a second end, and a means for securing the second cable end to the second channel; wherein the first and second channels include a means for securing the first channel to the second channel after the second channel is rotated into engagement with the first channel. The cable may consist of a strap or any of the forms of tensile members discussed above, but again is preferably a cable that provides at least some degree of security from theft. The first and second cable ends may be from a single cable or from two separate cables.

The means for securing the first cable end to the second end of the first channel preferably consists of a means for compressing the first cable end between two rigid elements. This means of compressing the cable end to secure it may consists of many conventional clamping arrangements, including threaded fasteners or a "vise-grip" type clamp. One of the preferred means of compressing the cable end is by using one of the internal surfaces of the first channel. This means may be any suitable compression device, but it preferably consists of at least one rotatable, threaded, nut-like device which when rotated compresses the cable end between a plate and the first channel to prevent the release of the cable end from the second end of the first channel. The nut-like device is preferably a t-shaped flat plate having a threaded hole which engages a threaded pin, the threaded pin being rigidly attached to the bottom of the first channel. This nut-like device allows for easy hand tightening and compression of the plate against the cable. The nut and plate may consist of a single integral component or may consist of two individual elements. This means of compressing the cable end may also include the use of a flexible or resilient disk or washer positioned beneath the nut-like device. This flexible washer will allow the nut to be gradually tightened while providing a degree of friction to prevent slippage. This flexible washer may be located above the cable end and beneath the nut like device or below the cable end and between the cable end and the internal surface of the channel. This washer or flat plate my be made from an elastomeric material, for example, nylon or rubber, or from a flexible metallic material, for example, a belleville spring washer may be used.

The means of securing the first end of the cable to the second end of the first channel may also include a rotatable element located further from the second end of the first channel than the nut-like device. This rotatable element, for example a pulley, typically rotates about a pinion which is rigidly connected to the first channel. After passing the nut-like device, the first end of the cable passes about this rotatable element and then doubles back toward the second end of the first channel, preferably beneath the nut-like device and plate. This rotatable element allows the cable to be easily tensioned by pulling on the free end of the cable while simultaneously securing the cable beneath the nut-like device. Thus the nut-like device may compress one or more lengths of cable when tightened in the first channel.

The nut-like device is preferably secured from rotation when the second channel is rotatably engaged with said first channel. For example, the nut-like device may include an upper section having a rectangular cross section and the second end of the second channel may include a complementary rectangular slot such that when the second channel is pivotably rotated to engage the first channel, the rectangular slot engages the rectangular nut section to prevent rotation of the nut-like device. The nut-like device may also include means for securing the first channel to the second channel when engaged, for example, the nut-like device may include one or more through holes in the rectangular section of the nut-like device for introducing a locking device, such as a pad lock.

The means for securing the second end of the cable to the second channel may consist of any conventional means, but is preferably a means in which the second end of the cable adjustably engages the second channel while being easily released. One preferred means consists of a series of pairs of u-shaped openings formed in plates positioned perpendicular to the bottom of the second channel. These openings preferably adjustably engage the second end of the cable. This adjustable engagement may be effected by any conventional means, but is preferably effected by use of a t-shaped element attached to the second cable end. This t-shaped element preferably is passed through a slot in the second channel and engages a pair of u-shaped openings located on either side of the slot. When the second channel is rotatably engaged with the first channel the t-shaped element is secured between the sides of the u-shaped slots and the bottom of the first channel.

This invention further consists of a device for securing one or more pleasure craft to prevent their theft or unauthorized use consisting of: a cable having a first end and a second end, having a t-shaped element at the second end; a first u-shaped elongated channel having a first end and a second end, having a means for adjustably securing the first end of the cable adjacent to the second end of the first channel and having a element adjacent to the second end and positioned perpendicular to the direction of elongation of the channel and the element having a through hole; a second u-shaped elongated channel having a first end pivotably connected to the first end of the first channel, a second end, and a plurality of u-shaped openings in the sides of the channel, between the first end and the second end, for receiving the arms of the t-shaped element of the cable and having a slotted hole through which the tab of the first channel can pass; wherein when the second channel is rotated about its first end and tightens the cable to secure the pleasure craft, the second channel engages the first channel and the perpendicular element of the first channel passes through the hole of the second channel such that a locking device can be inserted into the through hole to prevent disengagement of the channels. The perpendicular element, which preferably protrudes above the top of the first channel, may consist of flat plate having one or more through holes; a rod, threaded nut, or screw having an eyelet or other hole; or a nut-like device with a through hole, as described above, or any other similar construction.

This invention further consists of a method of securing a first cable end to a second cable end of one or more cables by using a device consisting of a first u-shaped channel having a first end and a second end. The first channel used in this method has a means for securing the first cable end adjacent to the second end, which consists of a threaded pin and a threaded-nut-like device, for example, as described above. The first channel further includes a second pin rigidly connected to said first channel, at a position further from the second end of the first channel than the nut-like device, and a rotatable disk-like element, such as a pulley, that rotates about the second pin. The method also uses a second u-shaped channel having a first end pivotably connected to the first end of the first channel, a second end, and a means for securing the second cable end to the second channel, such as described above. The device used in this method also includes a means for securing the first channel to the second channel after the second channel is rotated into engagement with the first channel. The method consists of the following steps: a) securing said second cable end to the second channel; b) passing said first cable end into said second end of said first channel and beneath said nut-like device; c) passing said first cable end about said rotatable disk-like element; d) tensioning said one or more cables by pulling said first cable end; e) rotating said nut-like device so that said first cable end is secured to the first channel; f) rotating said second channel into engagement with said first channel; and g) securing said second channel to said first channel to prevent disengagement of the two channels.

The second cable end used in this method may include a t-shaped element and the second channel may include a slotted hole and a series of u-shaped slots, wherein step a) comprises the further steps of a1) passing the t-shaped element through the slotted hole of the second channel and a2) engaging the t-shaped element with the u-shaped slots of the second channel.

The Step c) of this method may also consist of the additional step c1) of, after passing the first cable end about the rotatable disk-like element, passing the first cable end back out the second end of said first channel. Also, step f) of the method may also consist of the further step f1) of, while rotating said second channel into engagement with said first channel, tensioning said second end so that said one or more cables are tensioned.

These and other embodiments of this invention will become more apparent upon review of the following drawings and the attached claims.

DETAILED DESCRIPTION OF DRAWINGS

Figure 1:
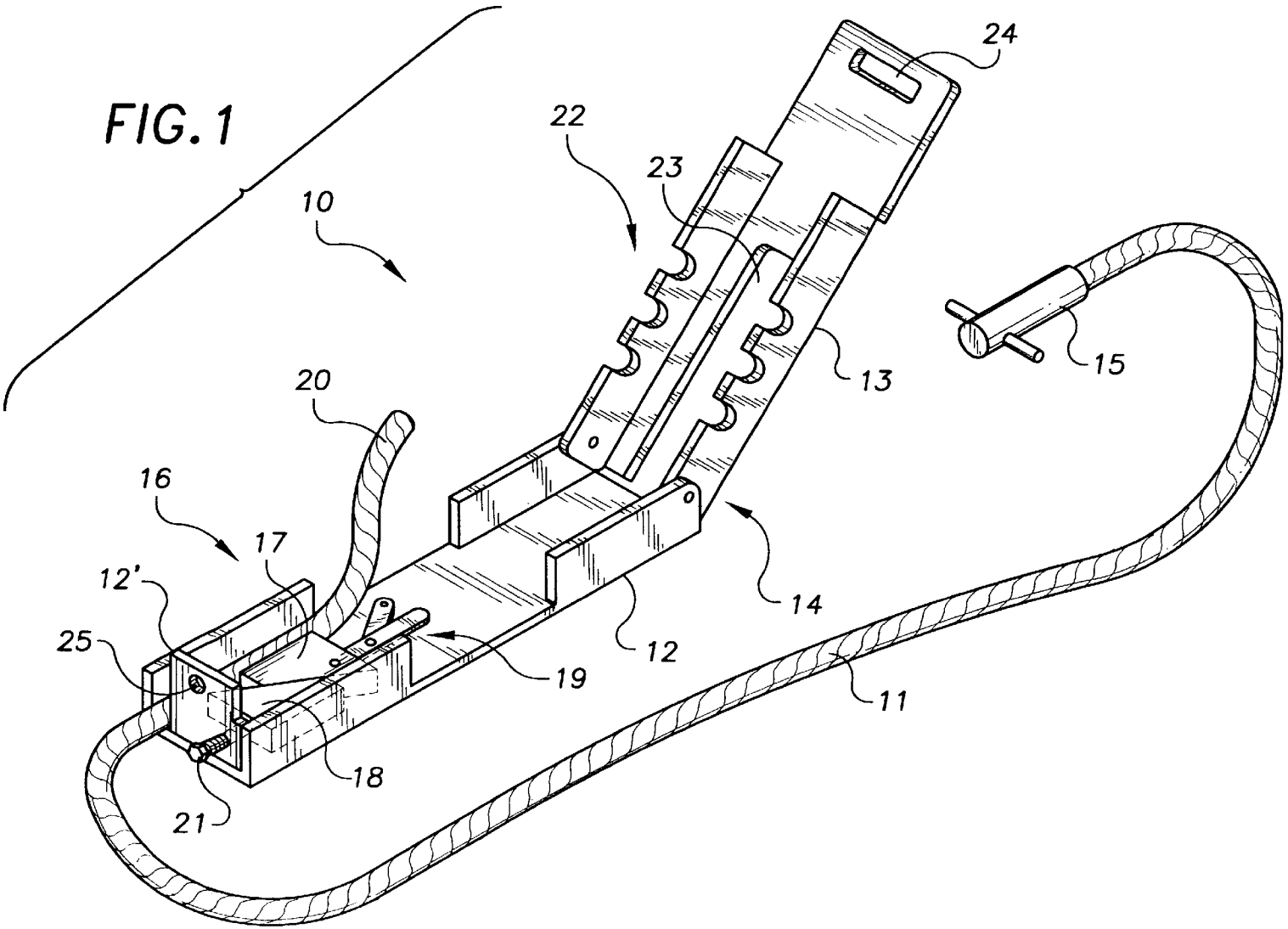
FIG. 1 illustrates an isometric view of an apparatus for securing two ends of a cable according to the invention.
Figure 2:
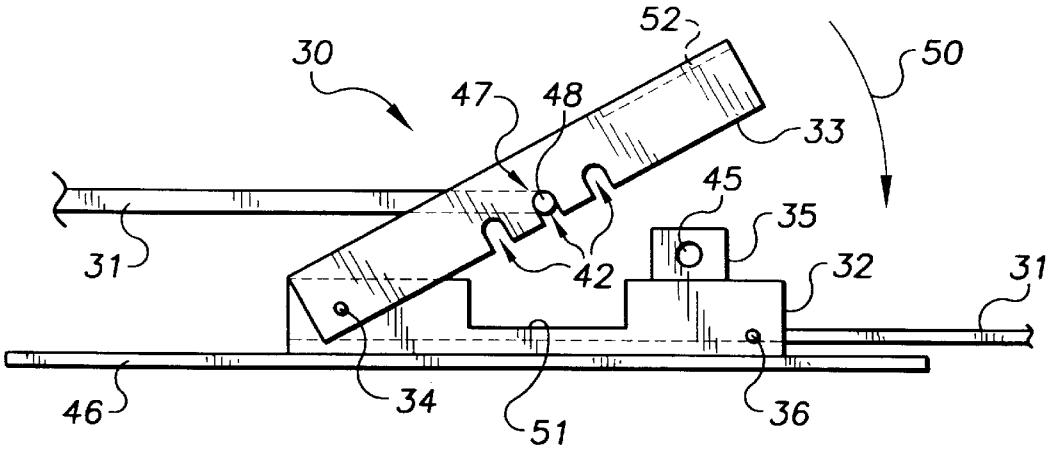
FIG. 2 illustrates a side elevation view of another means for securing two ends of a cable according to the present invention.
Figure 3:
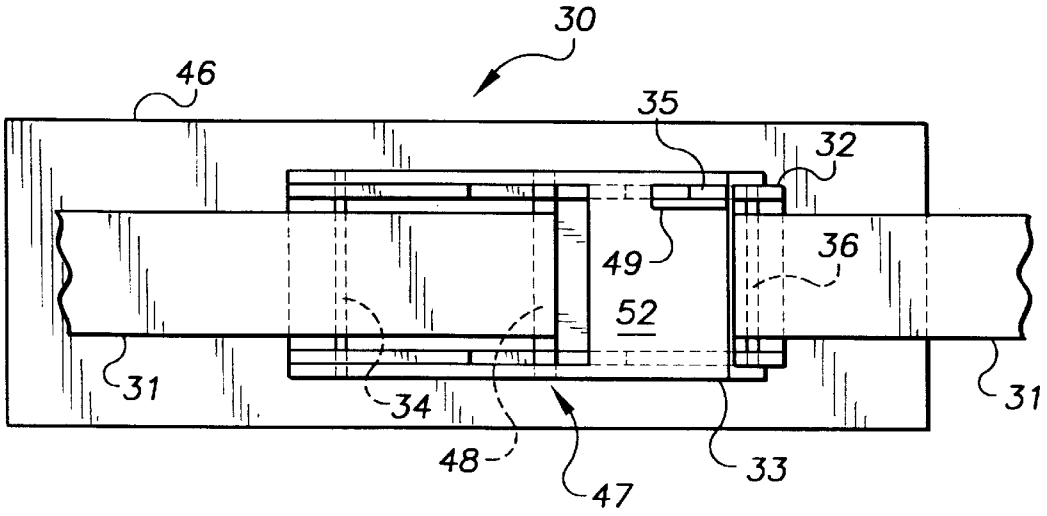
FIG. 3 illustrates a plan view of the device shown in FIG. 2.

FIG. 1, 2 and 3 illustrate several embodiments of the present invention used to secure the ends of a cable, for example, to secure the ends of a cable used to secure a pleasure craft to a rigid support. FIG. 1 illustrates an isometric drawing of one typical embodiment of this invention. This invention consists of cable locking device 10, which includes a cable 11, for example, a plastic covered braided steel cable, a first channel 12, and a second channel 13 pivotably connected to the first channel at 14. Cable 12 includes an element 15 at one end that engages channel 13. Element 15 is shown have a preferred t-shape, but any appropriate element geometry which can be used to engage the end of cable 11 to channel 13 can be used, for example, a spherical ball-type element attached to the end of cable 11 could be used. Channel 12 includes a tab 12', preferably protruding above the top of channel 12, having a through hole and a cable securing mechanism 16. In the embodiment shown in FIG. 1, the cable securing mechanism consists of set of cooperating wedges 17, 18 and a set of levers 19, though a single lever may be used. Movable wedge 17 is deflected by levers 19 so that wedge 17 bears against wedge 18 such that the end of cable 11, that is, end 20, is wedged between wedge 17 and the inside wall of the channel 12. The position of wedge 19 is adjusted by means of threaded screw 21 which also engages the bottom of tab 12'. Channels 12, 13, are typically metallic, for example steel or aluminum and may consist of structural channels or may be fabricated channels, for example, by welding.

In order to operate mechanism 16, the cable end 20 is positioned between wedge 17 and the inside wall of channel 12. The position of wedge 18 is grossly adjusted by means of threaded screw 21 such that the clearance between wedges 17 and 18 is minimized. The levers 19 are deflected such that the wedging action of wedge 17 upon wedge 18 pinches and secures the cable end 20 to the channel 12.

The sides of channel 13 include a plurality of u-shaped slots 22 which engage the arms of t-shaped element 15 at the end of cable 11. Channel 13 also includes an elongated slot 23 and a smaller slot 24. The t-shaped element 15 is passed through slot 23 and engages slots 22. In order to tighten cable 11 about the craft or other object (not shown) and secure it to a rigid support (also not shown), channel 13 is rotated about pivotable connection 14 until channel 13 engages channel 12. The slot 24 is located so that tab 12' of channel 12 passes through slot 24. A locking device (not shown) can be passed through the hole 25 in tab 12' to prevent separation of the two channels and to prevent release of cable 11. Note that mechanism 16 and t-shaped element 15 are concealed within channels 12 and 13 when these channels are engaged so that they cannot be tampered with.

FIGS. 2 and 3 illustrate typical elevation and plan views, respectively, of another embodiment of this invention 30 similar to invention 10 shown in FIG. 1. In this embodiment the invention consists of a first u-shaped channel 32 and a second u-shaped channel 33 which are rotatably connected by, for example, pin 34. Again, channels 32, 33, are typically metallic, for example steel or aluminum and may consist of structural channels or may be fabricated channels, for example, by welding or riveting. Pin 34 may be a bolt and nut, a pin with cotter pin retainers, or any form of connection that allows channel 32 to rotate relative to channel 33. This connection may also consist of individual pins or connections on either side of the channels, that is, it need not be a single pin engaging both sides of the channels, for example, rivets may be used. A resilient pad 46 may be positioned under channel 32 to prevent damage to the surface upon which device 30 is placed (not shown), for example, the surface of a surf board. The pad 46 may be made of plastic, rubber, cloth, or any other suitable material.

The invention engages the two ends of strap 31 which, for example, retains one or more pleasure craft, not shown, to a stationary or non-stationary structure, for example a wall or car roof. Though shown as a strap, for example, a strap made of woven nylon fibers or Kevlar or one re-inforced with metal wire, it is understood that element 31 may also be a cable, chain or other type of tensile element, as discussed above.

Channel 32 includes a means 36 for attaching the first end of strap or cable 31 to channel 32. For example, see mechanism 16 of FIG. 1. This attachment is preferably adjustable to allow for gross adjustment of the length of the cable or strap 31. For example, the means for attaching the cable to channel 32 may consist of a pawl-type device or a wedge-type device.

Channel 32 also preferably includes at least one perforated tab 35, similar to tab 12' of FIG. 1, having at least one through hole 45. This tab is preferably located at the end of channel 32 opposite the end that engages channel 33 via pin 34. This tab is shown positioned perpendicular to the axis of elongation of channel 32 and located along one side of channel 32, but it may also be positioned anywhere along channel while not interfering with he strap or cable 31.

Channel 33 includes a means 47 for attaching the second end of strap 31 to channel 33. The means shown in FIGS. 2 and 3 consists of a pin 48 attached to the second end of strap 31. Pin 48, which again is typically metallic, engages channel 33 via pairs of u-shaped openings, 42, in the bottom of channel 33. There are typically a plurality of pairs of openings 42 to allow for adjustment of the tension produced when strap 31 is tightened. The ends of pin 48 engage and are retained by the openings 42. Though an adjustable pin and slot arrangement is shown, any type of adjustable connection may be used to attach strap 31 to channel 33. Channel 33 preferably includes at least one slotted hole 49 (see FIG. 3) at the end of channel 33 opposite the pin connection 34 to receive tab 35 of channel 32.

The inventions shown in FIGS. 1, 2 and 3 operates as follows. After engaging and adjusting the first end of cable/strap 11, 31 in the connecting means 16,36 of channel 12, 32 and then engaging and adjusting the second end of cable/strap 11, 31 in means 22, 47, channel 13, 33 is rotated in the direction of arrow 50 (see FIG. 2) such that channel 13, 33 engages channel 12, 32 and cable/strap 11, 31 is tightened. Tab 12',35 and slot 24, 49 are so aligned that tab 12', 35 passes through slot 24, 49 and hole 25, 45 is exposed above channel 13, 33. A locking device, such as a conventional padlock or combination lock, can be inserted into hole 25, 45 to prevent disengagement of channel 13, 33 from channel 12, 32 and thus securing cable/strap 11, 31 around the retained article (not shown) and retaining it to the rigid support (not shown).

It is understood that certain modifications can be made to the channels and the means for engaging the strap to facilitate operation and assembly. For example, in FIGS. 2 and 3, channel 32 may include a cut-out 51 which prevents interference between the end of pin 48 and the sides of channel 32 when channel 33 is rotated about 34. Also, channel 33 may be modified to prevent interference between strap 31 and pin 48 when the invention is in the open position, as shown in FIG. 2. For example, some of the top section of channel 33 may be removed such that the top of channel 33 consists of one or more sections 52 adjacent the end opposite pin 34. For reasons of structural integrity, additional sections similar to section 52 (not shown) may also be located at the end of the channel 33 adjacent pin 34.

In FIGS. 2 and 3, the engaging and adjustment means 36 and 47 are preferably means that can be concealed when the invention is in the closed position. For example, the means 36 is preferably sufficiently compact that after adjusting and securing strap or cable 31 and closing the assembly, means 36 and 47 are completely enclosed within channels 32 and 33 or at least cannot be disengaged when the assembly is closed.

In a preferred embodiment of the invention, the strap 31 consists of a braided steel cable having a protective non-abrasive, for example, plastic, cover. Furthermore, as shown in FIG. 1, this cable preferably includes a t-shaped element at the end which engages means 47 such that the arms of the t-shaped element function as the pin 48 and engage the u-shaped holes 42. In addition, the cable may engage channel 32 at 36 by means of an adjustable pawl or vice-type mechanism which permits ease of engagement and gross adjustment of the cable length and ease of disassembly.

Figure 4:
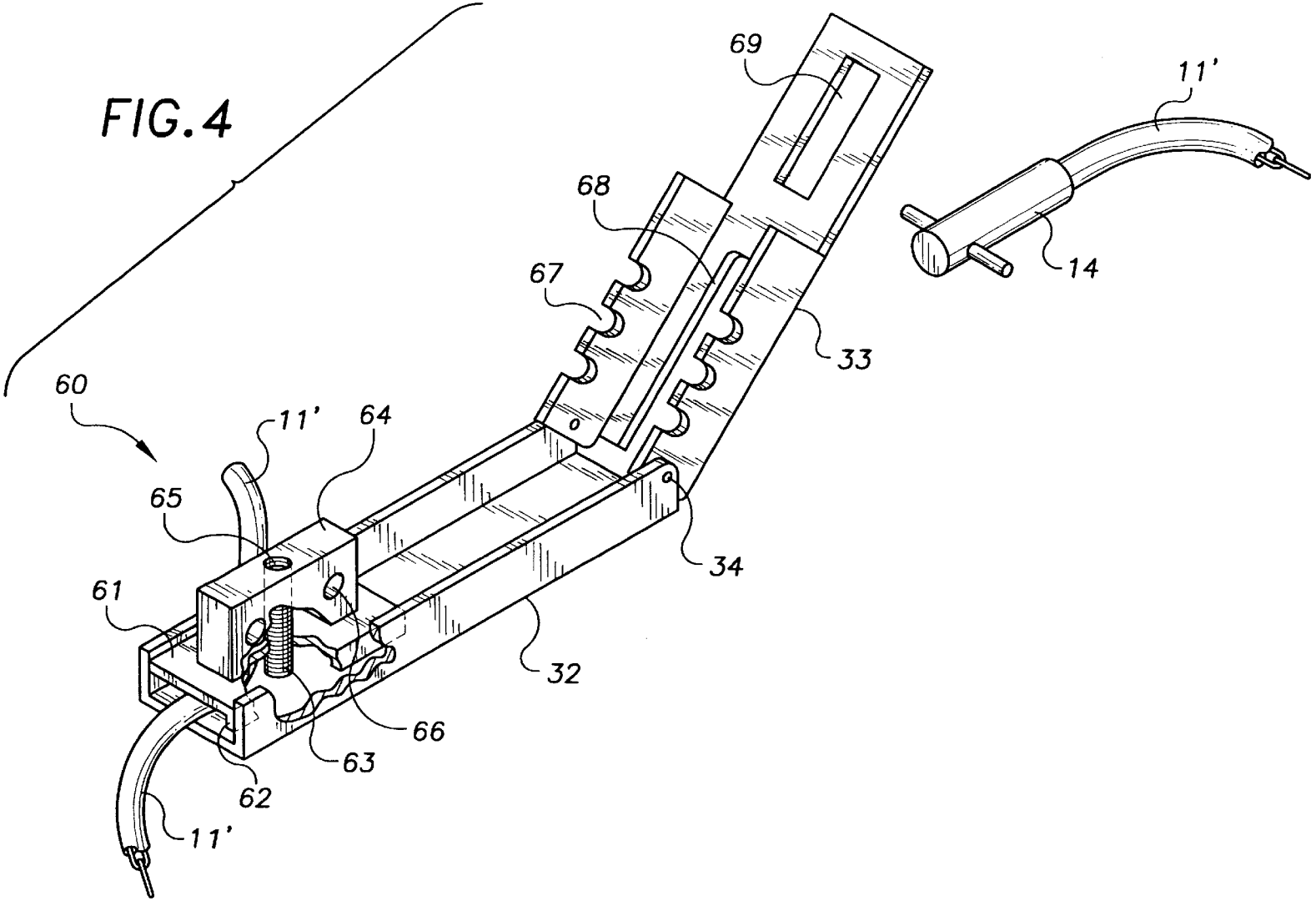
FIG. 4 illustrates an isometric view, partially in cross section, of a further embodiment of this invention.

A further embodiment of this invention is shown in FIG. 4. FIG. 4 illustrates an isometric view, similar to FIG. 1, having an alternative means 60 for attaching cable 11' to one end of the invention. Items in FIG. 4 which are similar or identical to items in FIGS. 2 and 3 are identified by the same numbers. In FIG. 4 channel 32 is pivotably connected to channel 33 at 34 in a manner similar to FIGS. 1 through 3. In the embodiment shown in FIG. 4, the means for attaching cable 11' to one end of channel 32 includes an L-shaped member 61 (with a section removed for clarity) having a perpendicular leg 62, a threaded rod 63, and a rectangular nut-like element 64 having a threaded hole 65 and at least one through hole 66. The threaded rod 63 is fixed at one end to the base of channel 32. The length of leg 62 of member 61 is sized so that it is somewhat shorter in length than the diameter of the cable 11'. Channel 33, in addition to the plurality of u-shaped slots 67 and slot 68, similar to those shown n FIG. 1, also includes a slotted hole 69. This slotted hole preferably has a major axis which lies parallel to the direction of elongation of channel 33, but may be oriented transverse to the direction of elongation of channel 33.

When utilizing the invention of FIG. 4, cable 11' is first inserted into one end of channel 32 and is passed beneath the L-shaped element 61 and then through an opening in the far wall of the channel 32 (not shown in FIG. 7, but which clearly can be seen in FIG. 1). The length of cable 11 is grossly adjusted to accommodate the article retained (not shown). The cable 11' is then secured to the channel 32 by rotating nut-like element 64 about threaded rod 63 such that nut 64 compresses L-shaped member 61 against the cable 11'. Again, the leg 62 of member 61 is sized to be slightly shorter than the diameter of the cable such that the cable is compressed beneath element 61 prior to the end of leg 62 impinging upon the bottom of channel 32. If desired, leg 62 may be omitted and element 61 may consist simply of a flat plate. After tightening, the nut 64 is preferably oriented with its major axis lying parallel to the axis of channel 32. In order to obtain this desired orientation, the thickness of element 61 or leg 62 is sized accordingly, or one or more shims may be inserted between member 61 and cable 11 or between nut 64 and element 61. The shims may be rigid metallic shims or flexible elastomeric shims. The shims may consist of a resilient washer or a metallic belleville-spring washer located beneath nut 64.

Once one end of cable 11' is secured to the channel 32, the other end of the cable 11' having a t-shaped element 14 is inserted through slot 68 in channel 33 and engaged to one set of the u-shape notches 67. With the cable so engaged, channel 33 is then rotated about 34 such that channel 33 engages channel 32 and nut 64 passes through slot 68. A locking device, such as a conventional padlock, is then inserted through the one or more holes 66 to prevent the disengagement of the channels. One significant feature of the embodiment shown in FIG. 4 is that, in addition to securing the engagement of the two channels, the slot 68 in channel 33 prevents the rotation of nut 64 such that the securing device 60 cannot be disassembled when the channels are engaged and the cable secured. It is to be understood that as an alternative embodiment the orientation of nut 64 and slot 69 may be perpendicular to the direction of elongation of channels 32 and 33 or oriented in any other oblique angle as long as they share a common orientation.

Figure 5:
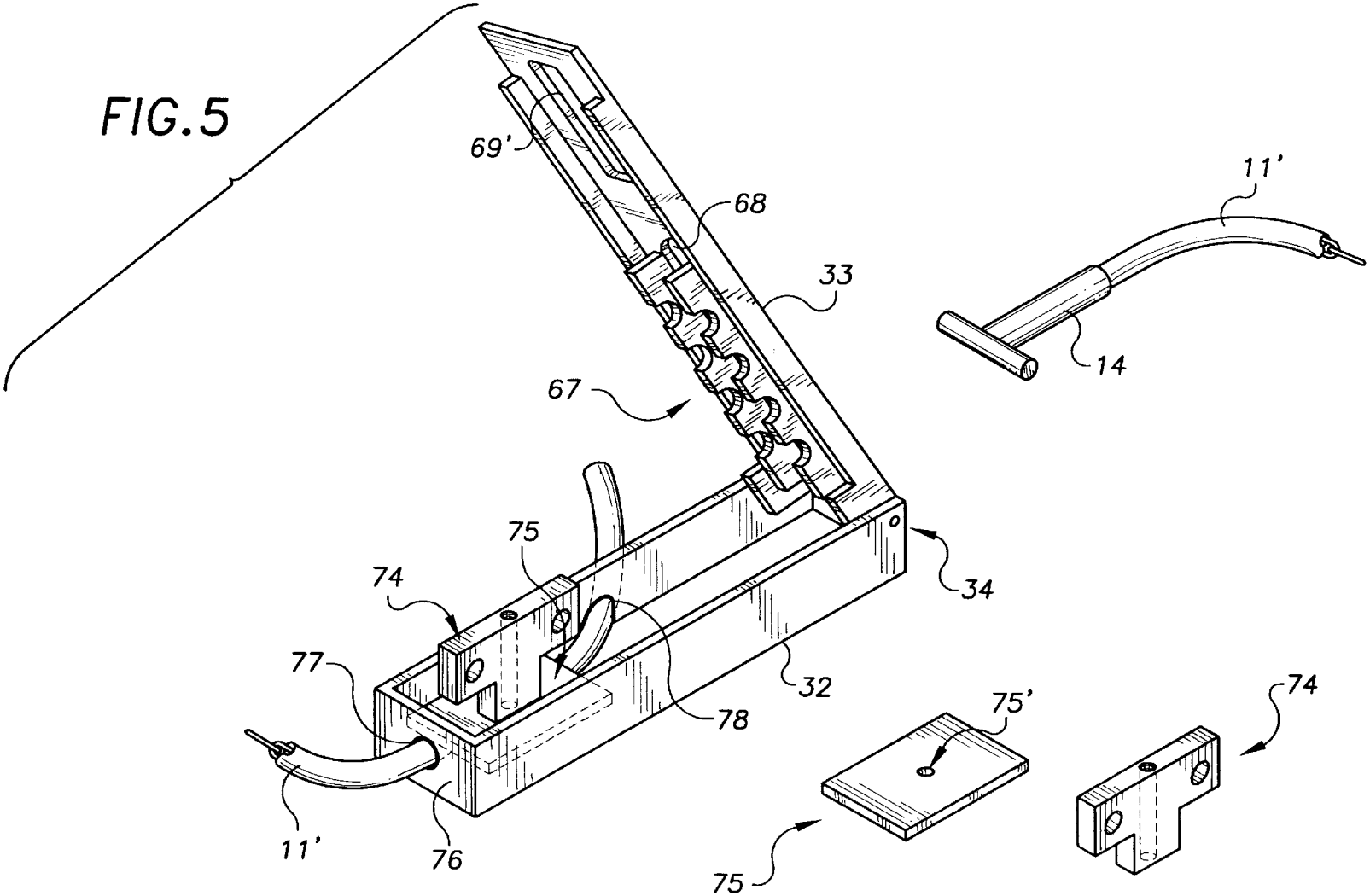
FIG. 5 illustrates a further embodiment of the invention similar to that shown in FIG. 4.
Figure 6:
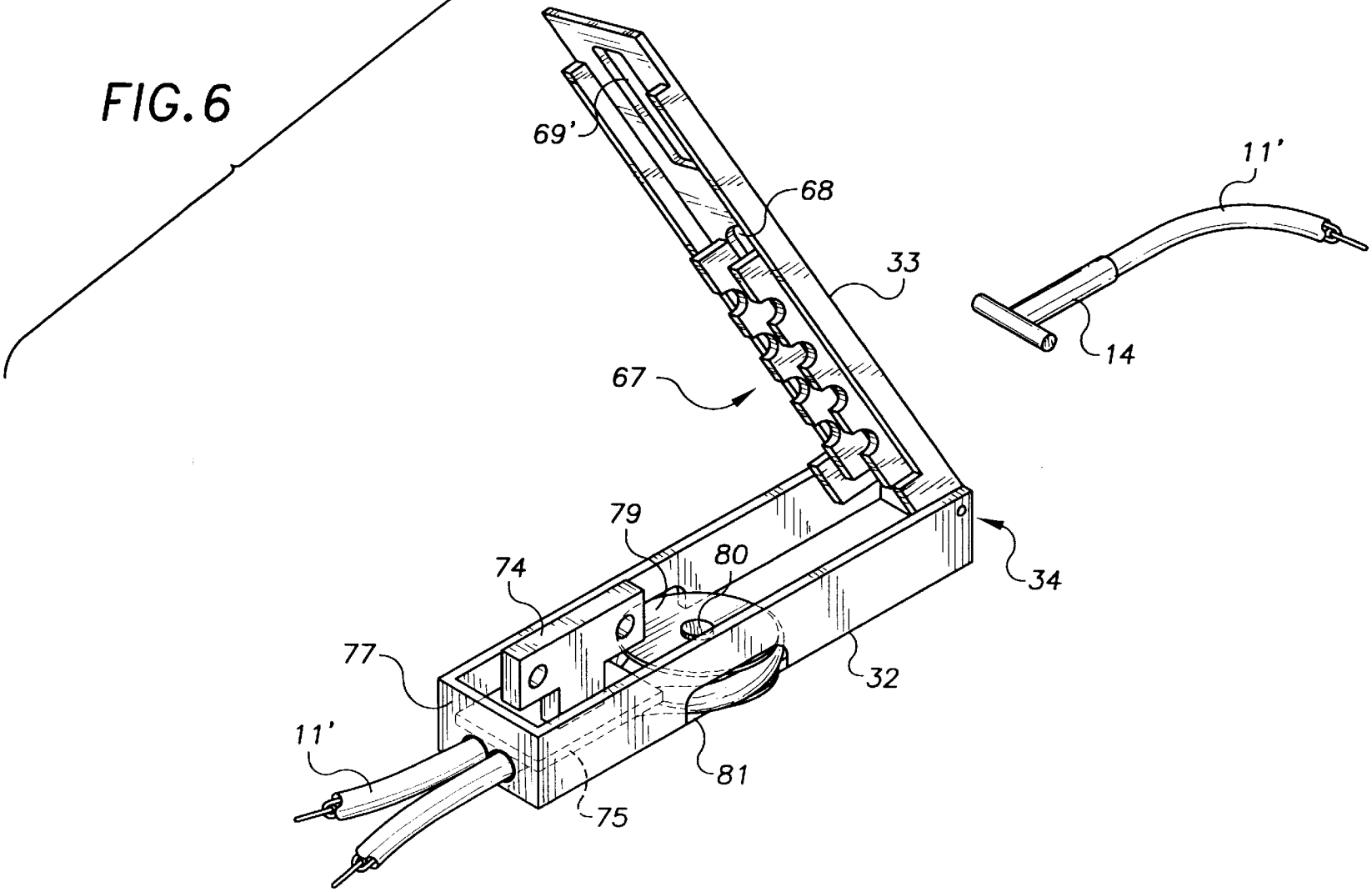
FIG. 6 illustrates a further embodiment of the invention similar to that shown in FIG. 5.

FIGS. 5 and 6 illustrate two preferred embodiments of the invention in which alternative methods of attaching the cable 11 to channel 32 are shown. FIG. 5 illustrates an isometric view of a device similar to that shown in FIG. 4. As in FIG. 4, the FIG. 5 embodiment includes a first channel 32, a second channel 33 pivotably connected to channel 32 at 34 and having notches 67 and slot 68 for accepting t-shaped element 14 of cable 11'. In FIG. 5, cable 11' is retained by threaded nut-like device 74, similar to nut 64 of FIG. 4, and flat plate 75 having through hole 75'. For clarity nut 74 and plate 75 are also shown in detail in FIG. 5. FIG. 5 also shows a slot 69' which engages nut 74 when channel 34 engages channel 32.

In contrast to FIG. 4, in FIG. 5, the channel 32 includes an end-plate 76 having a through hole 77. This through-hole 77 aids in positioning the cable beneath the plate 75. Through-hole 77 may include a wear-resistant, friction reducing grommet to prevent abrasion of the cable as it passes through plate 75. This grommet may be made from plastic or Teflon® or other similar materials. Another alternative for guiding the cable 11' out the end of channel 32 is by omitting the plate 76 and locating a cylindrical surface on either side of cable 11' as it enters channel 32. These surface may be provided by cylinders attached to and having an axis perpendicular to the bottom of channel 32. FIG. 5 also shows that channel 32 may have a through hole 78 in the side of channel 32 to allow the cable to exit the channel after passing under the nut 74 and plate 75 so that the cable can be tensioned during use. Cable 11' may also lie along the length of channel 32 and exit the channel from the far end adjacent 34.

FIG. 6 illustrates an embodiment similar to those shown in FIGS. 4 and 5. The FIG. 6 embodiment includes a rotatable element 79, such as a circular disk or conventional pulley, that is rotatable around a pinion 80 fixed to the channel 32. After passing under nut 74 and plate 75, cable 11' can be wound around element 79 and then directed back under the nut 74 and plate 75. This doubling back of the cable facilitates the tensioning of the cable while the cable is compressed by nut 74 and plate 75. This doubling back also increases the resistance of the cable from slipping from beneath plate 75 by compressing two lengths of cable under the plate. As shown, if necessary, through holes 81 may be introduced to the sides of channel 32 to allow for room for the cable to pass over element 79 without bearing on the inside of the channel. The attachment of the t-shaped element 14, or other attachment device, the rotating of channel 33 into engagement with channel 32, and the engagement of slot 69' with nut 74 are as shown in and described for FIGS. 4 and 5.

Figure 7A:
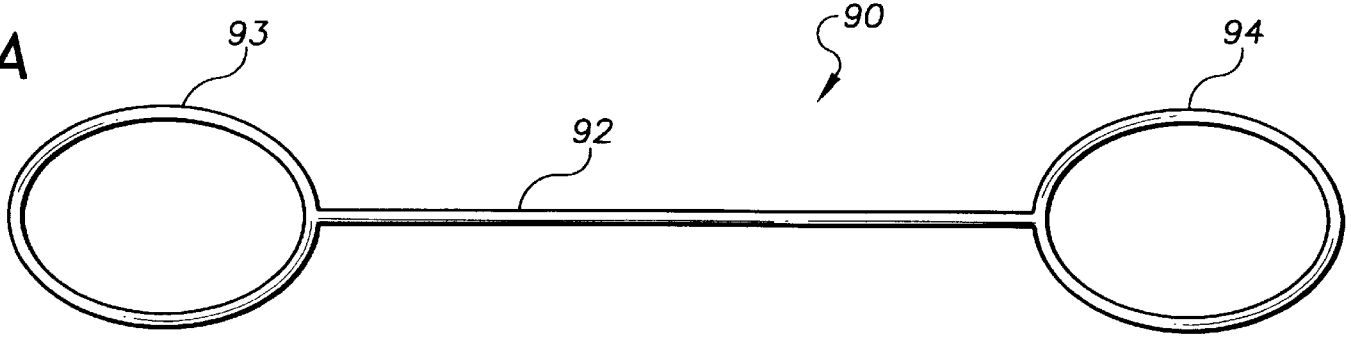
FIGS. 7A, 7B, 8A, 8B, 8C, 9A and 9B illustrate additional embodiments of this invention for securing pleasure craft to a rigid support.
Figure 7B:
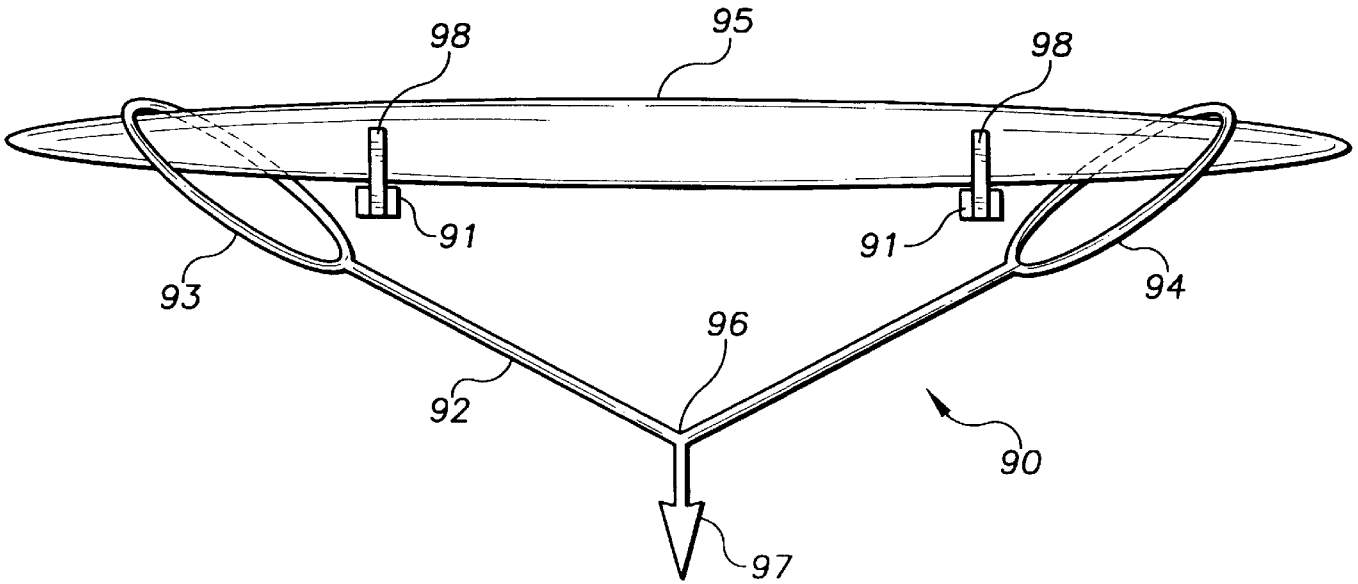

FIGS. 7A and 7B illustrate another embodiment of the present invention 90 for securing one or more pleasure craft to a rigid support, for example, support 91. This embodiment consists of a central cable 92 having terminal loops 93 and 94. The device shown in FIG. 7A is marketed under the name SPECTACLE™ Board Lock by Hinkey Products of Glens Falls, N.Y. As discussed for other embodiments, cable 92 and terminal loops 93 and 94 may consist of any form of tensile member including natural fiber or synthetic rope, chord, or strap; or metal chain or cable; and the like. Combinations of these tensile members may also be used, for example, the central cable 92 may be made from vinyl-covered steel aircraft cable and the terminal loops 93 and 94 of synthetic plastic straps. As shown in FIG. 7B, loops 93 and 94 are typically placed over the respective ends of a craft 95, such as a wind-surfer board, and passed beneath horizontal supports 91. At a point 96 along the length of cable 92 a means of providing tension 97 is introduced causing the loops 93 and 94 to restrain the craft 95 against the supports 91. This means of supplying tension may be any appropriate means including, but not limited to, another cable that is secured to a rigid mounting, or a cable and pulley arrangement, or simply a padlock that secures cable 92 to a rigid support. The supports 91 may also include means for preventing the lateral movement of the craft such as uprights 98. The supports 91 and uprights 98 may also be padded or otherwise covered to prevent abrasion of the craft during restraint, removal, or transport. Of course, one or more devices 90 having a common source of tension 97 may be used to secure one or more craft.

Figure 8A:
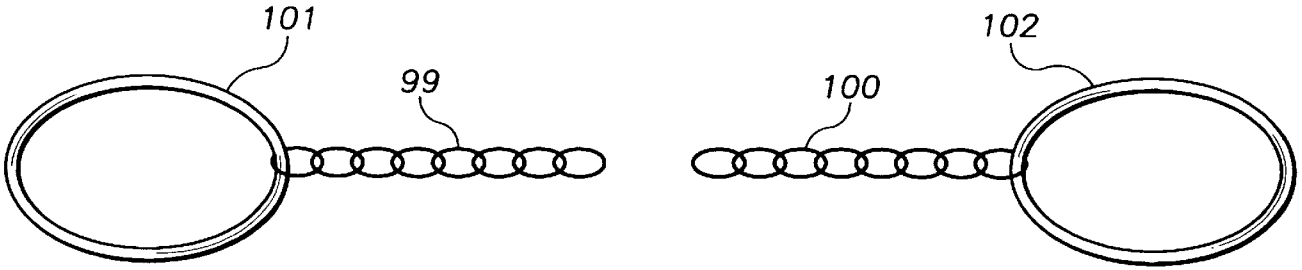
Figure 8B:
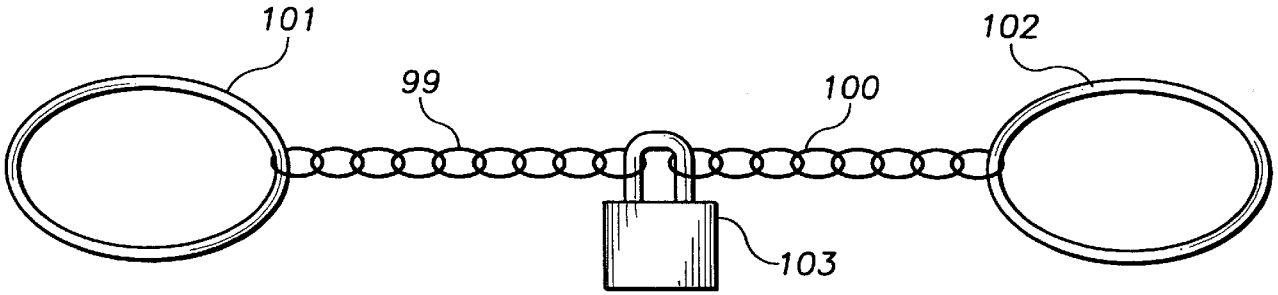
Figure 8C:
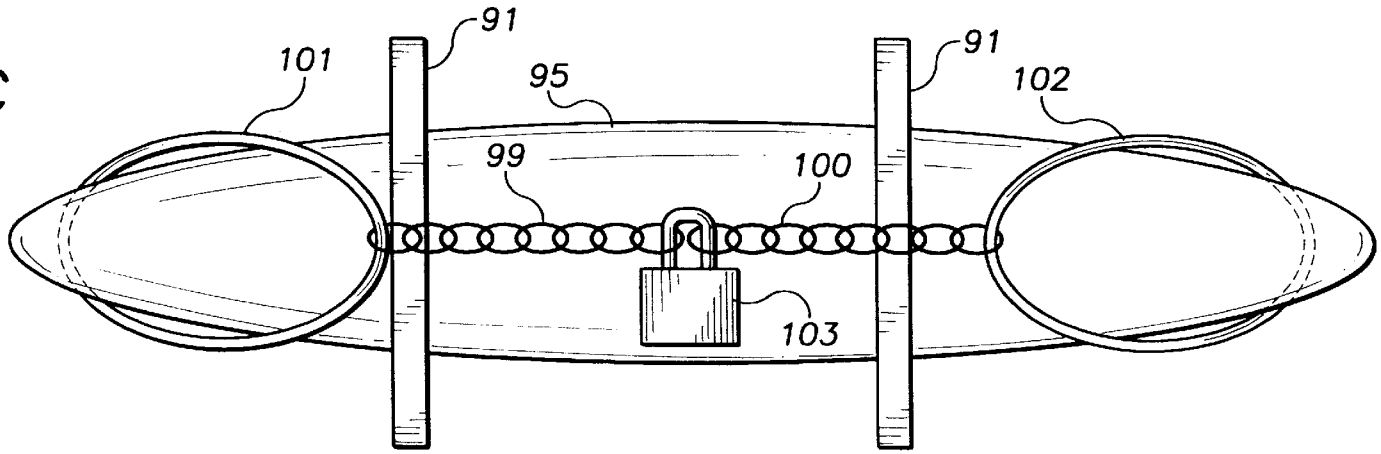

FIGS. 8A, 8B, and 8C illustrate another embodiment of the present invention similar to that shown in FIGS. 7A and 7B. In this embodiment, the central cable 92 is composed of two lengths of metal chain 99 and 100 attached, respectively, to terminal loops 101 and 102. Though shown as chains, 99 and 100, as well as loops 101 and 102, may consist of any suitable cable as discussed above. As shown in FIG. 8B, chains 99 and 100 may be connected by means of a conventional pad lock 103, or other suitable locking device. FIG. 8C illustrates how the device shown in FIGS. 8A and 8B can be used to secure pleasure craft 95, for example, a snow board, to rigid supports 91, such as a car roof rack. FIG. 8C is a bottom view of the arrangement of craft 95 to supports 91. Supports 91 may be covered to prevent abrasion and may includes lateral restraining uprights as shown in FIG. 7B.

Figure 9A:
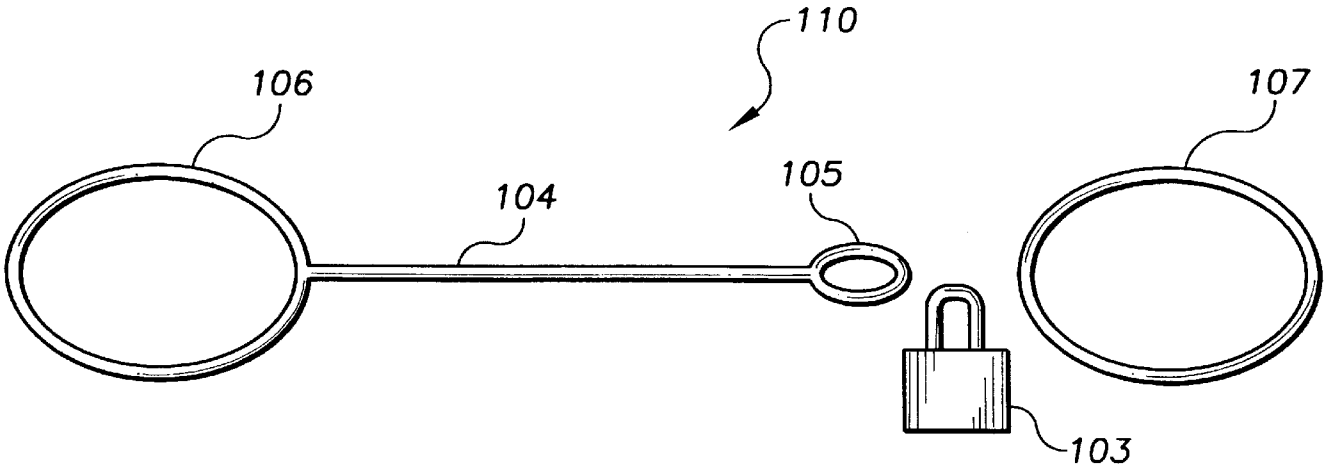
Figure 9B:
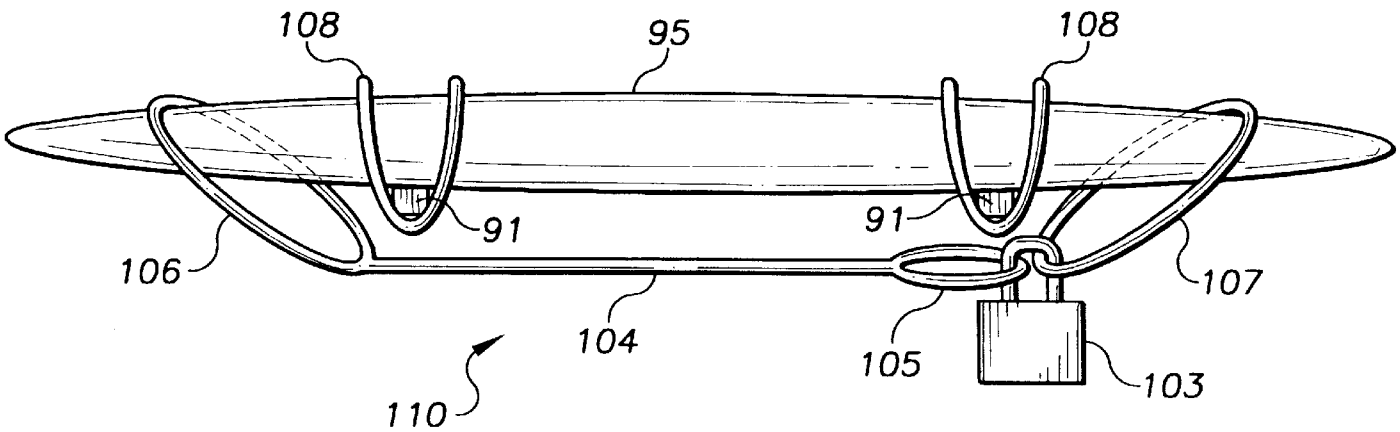

FIGS. 9A and 9B illustrate another embodiment 110 of the present invention. Similar to the embodiments shown in FIGS. 7A and 8A, FIG. 9A illustrates a device 110 having one cable 104 having a larger terminal loop 106 and a smaller terminal loop 105, and a separate cable loop 107. Loops 105 and 107 are secured to each other by any suitable locking means, such as pad lock 103.

FIG. 9B illustrates how the device shown in FIG. 9A can be used to secure pleasure craft 95, for example, a surf board, to rigid supports 91, such as a car roof rack. FIG. 9B is a side view of the attachment of craft 95 to supports 91. Supports 91 may be covered to prevent abrasion and may includes lateral restraining uprights as shown in FIG. 7B. Also shown in FIG. 9B are lateral restraints 108, such as elastic cords, that can be used to prevent the craft from moving during restraint, removal or transport. Again, cable 104 and loops 105, 106 and 107 may be made of any appropriate material as discussed above.

Figure 10:
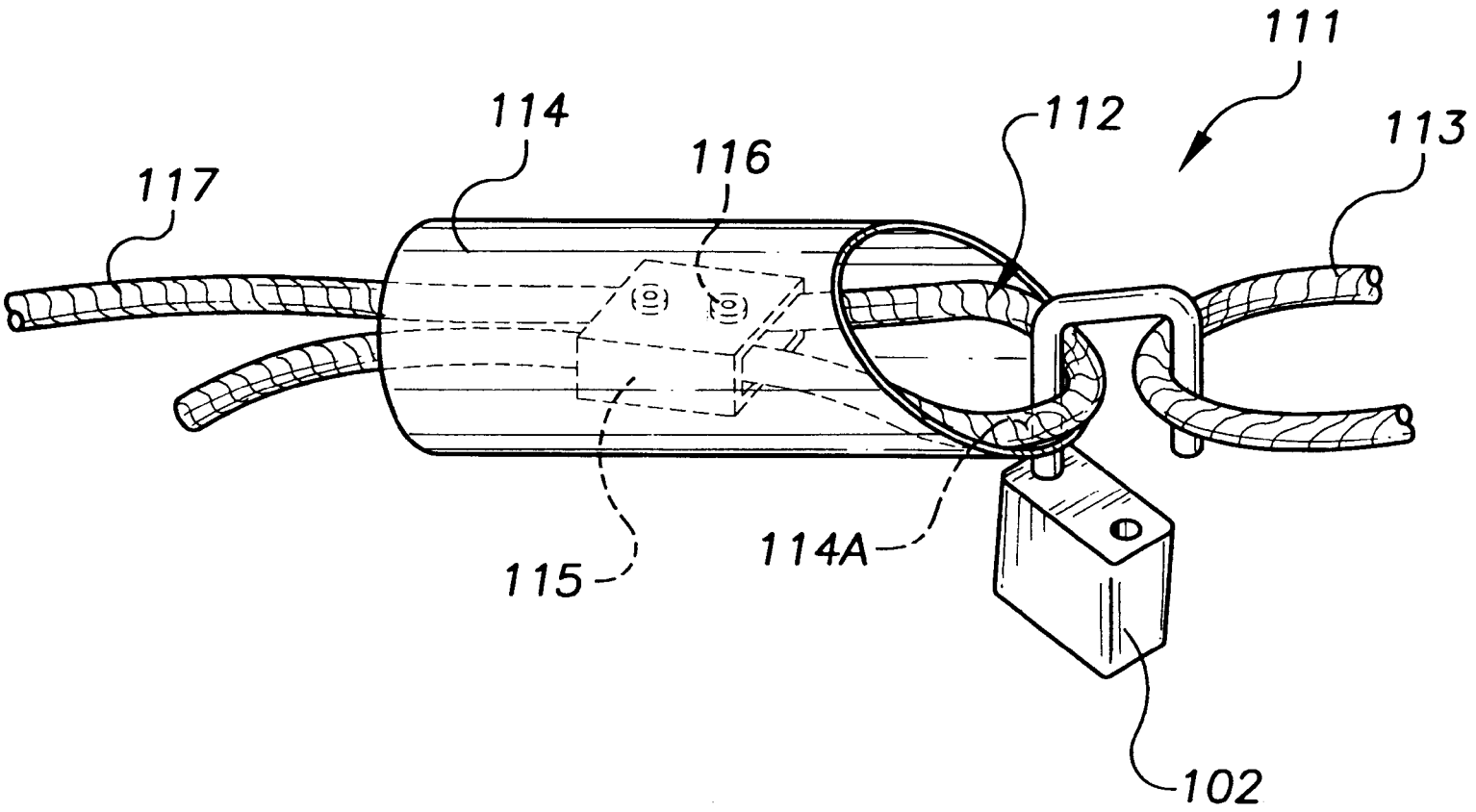
FIG. 10 illustrates an apparatus for securing the ends of a cable which can be used in the inventions shown in FIGS. 7A, 7B, 8A, 8B, 9A, and 9B.

FIG. 10 illustrates a preferred apparatus 111 for securing two terminal cable loops 112, 113, for example for securing cable 99 to cable 100 in FIG. 8C, or loop 105 to loop 107 in FIG. 9B. Device 111 consists of a hollow cylinder 114, preferable a steel cylinder, such as a pipe, though other materials may be used. The cylinder, or "security cover" conceals the adjustable connector 115 used to form the terminal loop in cable 117. For example, the adjustable connector 115 may consist of cable clamp having two mating halves held together by one or more screws 116 as shown, though other types of devices may be used.

The cylinder preferably includes a means for securing the security cover to prevent its removal. This means preferably can be used in conjunction with a cable locking device, such as a pad lock, to simultaneously secure the two terminal loops and the security cover. For example, as shown in FIG. 10, a through hole 116 through which the locking device, such as a pad lock 103, which is used to secure the two terminal loops 112 and 113 also secures the security cover 114 and prevents access to the cable clamping device 115. The end of the cover 114 adjacent to the through hole 116 is preferably beveled to facilitate access to the hole 116 by the locking device, for example, the pad lock 103. The cylinder 114 may have a cross section that is round, oval, square, rectangular or any other geometry that can accommodate the cable and cable connector geometry.

Of course, any of the cable securing devices illustrated in FIGS. 1 through 6 may also be used for the cable connecting devices shown in FIGS. 7 through 9.

As described above, the methods and devices of this invention provide means for securing the ends of cables and for securing one or more pleasure craft from theft or unauthorized use while facilitating the act of securing and releasing the cables and craft. It is to be understood that modifications and alterations can be made to the specific devices and methods disclosed in this application without deviating from the essence of the invention.

What is claimed is:

1. An apparatus for securing a first cable end to a second cable end comprising:

a first u-shaped channel having a first end and a second end, the first channel having a means for securing the first cable end adjacent to the second end of the channel and having a rigidly mounted threaded pin;

and a second u-shaped channel having a first end pivotably connected to the first end of the first channel, a second end, and a means for securing the second cable end to the second channel;

wherein the first and second channels include a means for securing the first channel to the second channel after the second channel is rotated into engagement with the first channel the means comprising a threaded device rotatable about the threaded pin and positioned adjacent the second end of the first channel and a through hole in the second channel positioned to receive the rotatable device when the two channels are engaged.

2. An apparatus as in claim 1, wherein the rotatable threaded device is a plate having a threaded hole and one or more through holes.

3. An apparatus as in claim 1, further comprising a flat plate positioned beneath the threaded device and engaging the threaded pin.

4. An apparatus as in claim 3, further comprising a resilient disk located beneath the flat plate.

5. An apparatus as in claim 3, wherein the threaded device and the flat plate are a single integral part.

6. An apparatus as in claim 1, wherein the threaded device is a t-shaped plate having a threaded hole and one or more through holes for accepting a locking device.

7. An apparatus as in claim 1 wherein the first channel also includes a pin rigidly connected to the first channel, at a position further from the second end of the first channel than the threaded device, and a rotatable element that rotates about the pin.

8. An apparatus as described in claim 7, wherein the rotatable element is a pulley.

9. An apparatus as described in claim 1, wherein the second channel includes a means for preventing the rotation of the threaded device when the second channel is rotated into engagement with the first channel.

10. An apparatus as described in claim 9, wherein the means for preventing the rotation of the threaded device comprises a through hole which engages at least one outer surface of the threaded device to prevent its rotation.

11. An apparatus for securing one or more pleasure craft to a rigid support to prevent their theft or unauthorized use comprising:

a cable having a first end and a second end, which engages the one or more pleasure craft and the rigid support, the second end of the cable having a t-shaped element;

a first u-shaped elongated channel having a first end and a second end, the first channel having a first rigid threaded pin adjacent the second end and a second rigid pin positioned further from the second end then the threaded pin;

a second u-shaped elongated channel having a first end pivotably connected to the first end of the first channel, a second end, a slotted hole adjacent the first end, a set of plates which straddle the slotted hole, the plates having a plurality of u-shaped openings in their sides for receiving the arms of the t-shaped element of the second end of the cable;

a threaded device that engages the first threaded pin of the first channel that compresses the cable;

a plate having a through hole positioned beneath the threaded device under which the cable passes and which compresses the cable when the threaded device is tightened; and a circular device mounted on the second pin over which the cable passes to facilitate tensioning of the cable while the threaded device is tightened.

12. An apparatus as in claim 11, wherein the disk-like device is rotatably mounted on the second pin.

13. An apparatus as in claim 12, wherein the means for securing the first channel to the second channel comprises an element positioned adjacent the second end of the first channel having a through hole and a through hole in the second channel positioned to receive the element when the two channels are engaged.

14. An apparatus as in claim 11, further including a means for securing the first channel to the second channel when the second channel is rotated into engagement with the first channel.

15. An apparatus for securing a first cable end to a second cable end comprising:

a first u-shaped channel having a first end and a second end, the first channel having a means for securing the first cable end adjacent to the second end of the channel and having a rigidly mounted threaded pin;

and a second u-shaped channel having a first end pivotably connected to the first end of the first channel, a second end, and a means for securing the second cable end to the second channel;

wherein the first and second channels include a means for securing the first channel to the second channel after the second channel is rotated into engagement with the first channel, the means comprising at least one threaded device rotatable about the threaded pin.

16. An apparatus as described in claim 15 wherein the means for securing the first cable end to the second end of the first channel further includes a plate located beneath the threaded device and engaging the threaded pin.

17. An apparatus as described in claim 16 wherein the means for securing the first cable end to the second end of the first channel further includes a resilient disk located beneath the plate.

18. An apparatus as described in claim 16, wherein the threaded device and the plate are a single integral part.

19. An apparatus as in claim 16, wherein the threaded device is a t-shaped plate having a threaded hole and one or more through holes for accepting a locking device.

20. An apparatus as in claim 15 wherein the first channel also includes a pin rigidly connected to the first channel, at a position further from the second end of the first channel than the threaded device, and a rotatable element that rotates about the pin.

21. An apparatus as described in claim 20, wherein the rotatable element is a pulley.

22. An apparatus as described in claim 15, wherein the second channel includes a means for preventing the rotation of the threaded device when the second channel is rotated into engagement with the first channel.

23. An apparatus as described in claim 22, wherein the means for preventing the rotation of the threaded device comprises a through hole which engages at least one outer surface of the threaded device to prevent its rotation.

24. An apparatus for securing a first cable end to a second cable end comprising:

a first u-shaped channel having a first end and a second end, the first channel having a means for securing the first cable end adjacent to the second end of the channel;

and a second u-shaped channel having a first end pivotably connected to the first end of the first channel, a second end, and a means for securing the second cable end to the second channel;

wherein the first and second channels include a means for securing the first channel to the second channel after the second channel is rotated into engagement with the first channel said means comprising a threaded device rotatable about a threaded pin rigidly mounted to said first channel.

25. An apparatus as in claim 24, wherein the threaded device is a t-shaped plate having a threaded hole and one or more through holes for accepting a locking device.

26. An apparatus as in claim 24 wherein the first channel also includes a pin rigidly connected to the first channel, at a position further from the second end of the first channel than the threaded device, and a rotatable element that rotates about the pin.

27. An apparatus as described in claim 24, wherein the second channel includes a means for preventing the rotation of the threaded device when the second channel is rotated into engagement with the first channel.

28. An apparatus as described in claim 27, wherein the means for preventing the rotation of the threaded device comprises a through hole which engages at least one outer surface of the threaded device to prevent its rotation.

29. An apparatus for securing a first cable end to a second cable end comprising:

a first unshaped channel having a first end and a second end, the first channel having a means for securing the first cable end adjacent to the second end of the channel;

and a second u-shaped channel having a first end pivotably connected to the first end of the first channel, a second end, and a means for securing the second cable end to the second channel;

wherein the first and second channels include a means for securing the first channel to the second channel after the second channel is rotated into engagement with the first channel and wherein the second cable end includes a t-shaped element and the second channel includes a slotted opening adjacent the second end of the second channel, wherein the means for securing the second end of the cable to the second channel comprises a set of parallel plates, which straddle the slotted opening, the plates having at least one pair of u-shaped openings which engage the t-shaped element after the t-shaped element passes though the slotted opening.

30. An apparatus as in claim 29, wherein the first channel includes a rigidly mounted threaded pin and wherein the means for securing the first cable end to the second end of the first channel comprises at least one rotatable, threaded device rotatable about the threaded pin.

* * * * *